United States Patent [19]

Brüderlein

[11] Patent Number: 5,037,535

[45] Date of Patent: Aug. 6, 1991

[54] SUPERPOSED TWO FRAME SYSTEM ELASTIC SCREENING MACHINE HAVING INDEPENDENT OSCILLATING DRIVES FOR EACH FRAME SYSTEM

[76] Inventor: Johannes Brüderlein, Menzelstrasse 12, 4130 Moers, Fed. Rep. of Germany

[21] Appl. No.: 545,506

[22] Filed: Jun. 29, 1990

[30] Foreign Application Priority Data

Jun. 29, 1989 [DE] Fed. Rep. of Germany ..... 3921349

[51] Int. Cl.[5] ..... B07B 1/36; B07B 1/42; B07B 1/49

[52] U.S. Cl. ..... 209/310; 209/325; 209/326; 209/327; 209/329; 209/331; 209/332; 209/365.4; 209/366.5

[58] Field of Search ..... 209/310, 325-327, 209/329, 331, 332, 363, 364, 365.1, 365.3, 365.4, 366, 366.5, 367

[56] References Cited

U.S. PATENT DOCUMENTS

| | | | |
|---|---|---|---|
| 3,378,142 | 4/1968 | Wehner | 209/325 |
| 3,647,068 | 3/1972 | Wehner | 209/310 |
| 3,954,604 | 5/1976 | Krause et al. | 209/325 |
| 3,971,715 | 7/1976 | Wehner | 209/310 |
| 4,188,288 | 2/1980 | Wehner | 209/310 |
| 4,287,056 | 9/1981 | Dumbaugh et al. | 209/366.5 X |

FOREIGN PATENT DOCUMENTS

| | | | |
|---|---|---|---|
| 7145669 | 6/1973 | Fed. Rep. of Germany . | |
| 2230812 | 1/1974 | Fed. Rep. of Germany . | |
| 2424007 | 11/1975 | Fed. Rep. of Germany | 209/365.4 |
| 0865426 | 9/1981 | U.S.S.R. | 209/331 |
| 1025462 | 6/1983 | U.S.S.R. | 209/325 |

*Primary Examiner*—Michael S. Huppert
*Assistant Examiner*—Edward M. Wacyra
*Attorney, Agent, or Firm*—Watson, Cole, Grindle & Watson

[57] ABSTRACT

In a screening machine comprising two screening frames (13 and 31) each having mutual oppositely located feed and discharge ends on which there is arranged an elastic screening lining (54) and which are caused to oscillate by independent oscillating drives wherein the two screening frames (13 and 31) are associated with each other at different heights in such a way that the lower region of the upper screening frame (31) and the upper region of the lower screening frame (13) lie in a common plane, that the elastic screening lining (54) is secured to the two screening frame (13, 31) in the common plane thereof and that the upper screening frame (31) is independently driven in a circular configuration at the feed end and the lower screening frame (13) is indepndently driven in a circular configuration at the discharge end.

18 Claims, 3 Drawing Sheets

I
I
1
1
8
9
10
13
13
14
15
16
17
18
19
20
22
23
24
25
26
27
28
29
30
31
31
32
33
34
35
36
37
38
39
42
43
44
45
46
47
48
49
50
51

SUPERPOSED TWO FRAME SYSTEM ELASTIC SCREENING MACHINE HAVING INDEPENDENT OSCILLATING DRIVES FOR EACH FRAME SYSTEM

BACKGROUND OF THE INVENTION

1. Technical Field of the Invention

The invention relates to a screening machine comprising two screening frames which are to be caused to oscillate and on which there is arranged an elastic screening lining and which are to be caused to oscillate by at least one oscillating drive.

2. Discussion of the Related Art

A known screening machine of that kind comprises two screening frames which oscillate relative to each other, each thereof having a plurality of transverse bearers to which an elastic screening lining is fixed. In relation to the central position of the screening frames relative to each other, the screening lining is longer than would correspond to the length of the frames so that the screening lining hangs down loosely between the individual transverse bearers. The entire screening lining therefore forms a plurality of screening web portions disposed in succession, which extend transversely with respect to the longitudinal direction of the screening machine, each screening web portion being disposed between two adjacent transverse bearers.

When the screening frames are at their one point of reversal of movement, some screening web portions of the screening lining are tensioned while the other screening web portions which are between the tensioned screening web portions hang down loosely between each two adjacent transverse bearers. At the other point of reversal of movement of the screening frames the tensioned condition of the screening web portions is reversed so that the screening web portions which have been previously tensioned now hang down between two respective adjacent transverse bearers and the screening web portions between them, which previously were loose, are now tensioned. Therefore the tensioned screening web portions and the sagging screen web portions alternate from one point of reversal of movement of the screening frames or the oscillating drives of the screening machine, to the other.

The two frames of the screening machine are caused to oscillate by mutually independent unbalanced drives in such a way that the two frames oscillate in 180° phase-shifted relationship with each other so that they are in a condition of mass equilibrium. The frames both oscillate in their longitudinal direciton, that is to say in one dimension in the same direction and in a common plane.

Another known screen machine has only a single screening box accommodating a plurality of transverse bearers to which the screening lining is secured. Provided at each of the transverse bearers is an unbalanced drive by which the associated transverse bearer is reciprocated, that is to say caused to oscillate, in the longitudinal direction of the screening frame. In this arangement the oscillations are generated in such a way that respective adjacent transverse bearers oscillate in 180° phase-shifted relationship so that those transverse bearers are also in a condition of mass equilibrium. The unbalanced drives for the transverse bearers are synchronized more specifically either mechanically by a chain drive or electrically by a synchronized circuit. As a result the screening machine is in a condition of mass equilibrium and does not apply any reaction forces to the place of mounting or the foundation structure.

These known screening machines suffer from a particular difficulty in that the movable parts of the screening machine, that is to say in particular the screening lining, must be sealed relative to the stationary parts of the screening machine which are adjacent thereto, in particular relative to the two side walls. That sealing effect is difficult to achieve and gives rise to particular wear and operational problems.

SUMMARY OF THE INVENTION

The invention is based on the problem of providing a screening machine of the kind set forth in the opening part of this specification in which the sealing problems in the region of the edge of the screening lining no longer occur and wherein, in the fine and very fine range of screening material and in particular in relation to materials which are difficult to subject to screening, particularly good screening results can be achieved by shearing forces in the plane of the screening lining.

In accordance with a first solution to that problem the invention provides that the two screening frames are associated with each other at different heights in such a way that the lower region of the upper screening frame and the upper region of the lower screening frame lie in a common plane, that the elastic screening lining is secured to the two screening frames in the common plane thereof and that the upper screening frame is driven at its feed end in a circular configuration in a horizontal plane and the lower screening frame is driven at its discharge end in a circular configuration in a vertical plane.

Also provided is a screening machine of the kind set forth above, wherein the edge sealing problems between the screening lining and the edge of the screening machine no longer arise. Added to this is the fact that particularly good screening results can be achieved with screening material in the fine and very fine range and in particular when dealing with materials which are difficult to screen. In this respect the cut-off is particularly good. As there are no relative movements between the screening lining and the side walls adjacent thereto, the edge sealing problem as between the screening lining and the side walls of the screening machine no longer arises.

As the upper screening frame and the lower screening frame are arranged at different heights in such a way that the lower region of the upper screening frame and the upper region of the lower screening frame are disposed in one plane, the lower region of the upper screening frame and the upper region of the lower screening frame can be used as a clamping region for the screening lining. In that way it is further possible for the upper screening frame to be displaced with circular movements in a horizontal plane at its feed end and at the same time the lower screening frame can be displaced with circular movements in a vertical plane at its discharge end. That means that the upper frame and the lower frame oscillate in mutually perpendicular planes, namely the upper frame oscillates in a horizontal plane and the lower frame oscillates in a vertical plane. The feed end of the upper frame experiences shearing forces at the screening lining, which have a particularly strong effect, so that particularly intensive screening effects already occur at the feed end of the upper screening frame. The effect of the shearing forces is negligible at the discharge end of the upper screening frame. At that location it is the effect of the upward and downward movement of the lower screening frame that is in the forefront of the screening action.

In accordance with a second solution to the problem the invention provides that the two screening frames are associated with each other at different heights in such a way that the lower region of the upper screening frame and the upper region of the lower screening frame lie in a common plane, that the elastic screening lining is secured to the two screening frames in the common plane thereof and that the upper screening frame is driven in a circular configuration in a vertical plane at its feed end and the lower screening frame is driven in a circular configuration in a horizontal plane at its discharge end.

In this arrangement the oscillation movements of the two oscillating frames are reversed relative to the first solution to the problem as described hereinbefore, more specifically in such a way that the lower oscillating frame oscillates in a horizontal plane while the upper oscillating frame oscillates in a vertical plane.

In addition, this arrangement also ensures that the previous edge sealing problems in relation to the known oscillating machines no longer arise and that particularly good screening results can be achieved, in particular in the fine and very fine range of the screening material and when dealing with difficult screening materials.

In accordance with a third solution to the problem the invention provides that the two screening frames are associated with each other at different heights in such a way that the lower region of the upper screening frame and the upper region of the lower screening frame lie in a common plane, that the elastic screening lining is secured to the two screening frames in the common plane thereof and that the upper screening frame, at its feed end, and the lower screening frame, at its discharge end, are each driven in a circular configuration in the same horizontal plane.

This arrangement also ensures that the edge sealing problems no longer arise. Furthermore, this arrangement provides particularly good screening results in the fine and very fine range of the screening material.

The oscillating drive can be in the form of an unbalanced drive or eccentric drive.

Desirably both screening frames are caused to oscillate at different frequencies such that no beat or interference phenomena occur, and are maintained in that condition. That means that the difference between the frequency of one frame and the frequency of the other frame must be sufficiently great.

Desirably the drive for the two screening frames is effected in such a way that the upper screening frame is driven at an oscillation rate in the range of 500, 750, 1000 or 1500 oscillations per minute and the lower screening frame is correspondingly driven at an oscillation rate in the range of 750, 1000, 1500 or 3000 oscillations per minute respectively, or in a correspondingly reversed relationship.

With for example an oscillation rate of 1000 oscillations per minute in respect of the upper frame, it is recommended that the oscillation rate of the lower frame should be 1500 oscillations per minute. In that connection it is not necessary to use precisely the above-indicated oscillations rates, b ut on the contrary it is possible to involve deviations in both directions in regard to those oscillation rates.

It is recommended that the screening frames are mounted at the drive end on a spring, for example a coil or rubber spring, and at the terminal end on a guiding link, for example a link spring.

BRIEF DESCRIPTION OF THE DRAWINGS

The invention is described in greater detail hereinafter by means of an embodiment illustrated in the drawings in which.

DETAILED DESCRIPTION OF THE PREFERRED EMBODIMENTS

Figure 1:
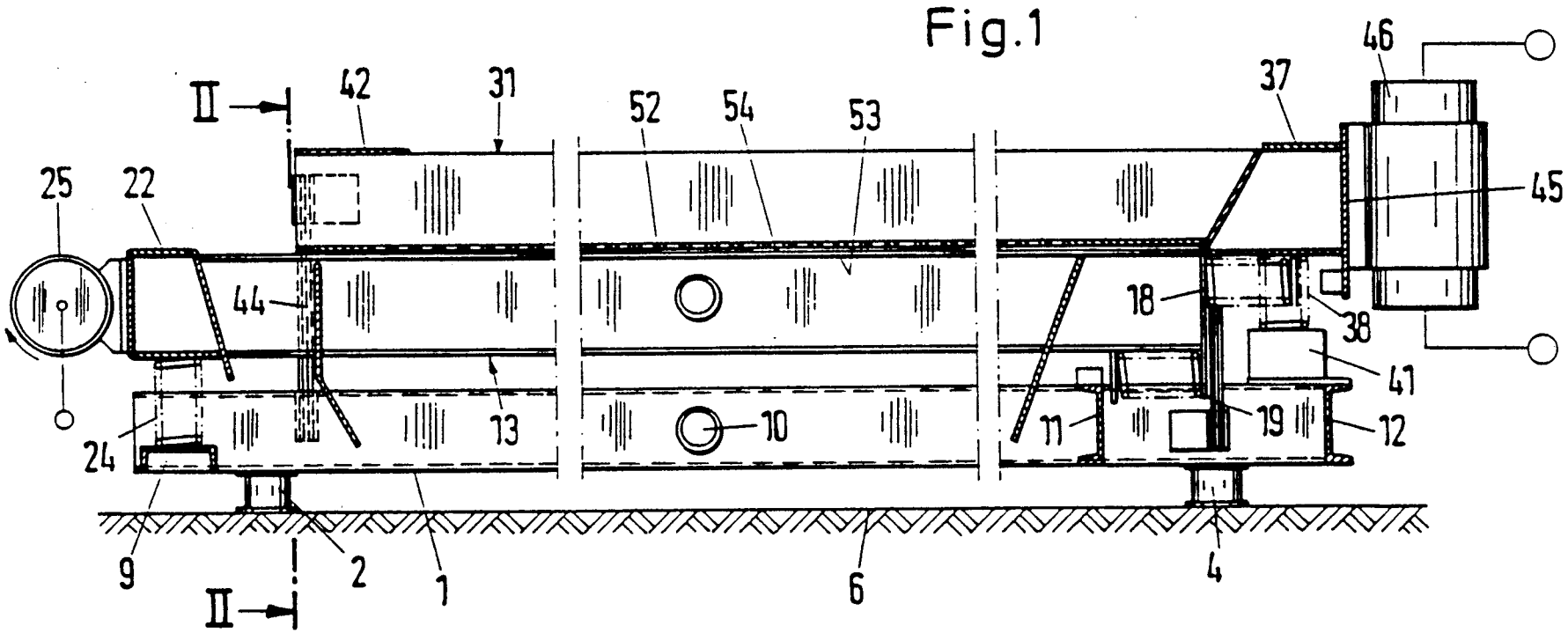
FIG. 1 is a view in longitudinal section taken along line I—I in FIG. 3, through a screening machine designed in accordance with the invention.
Figure 2:
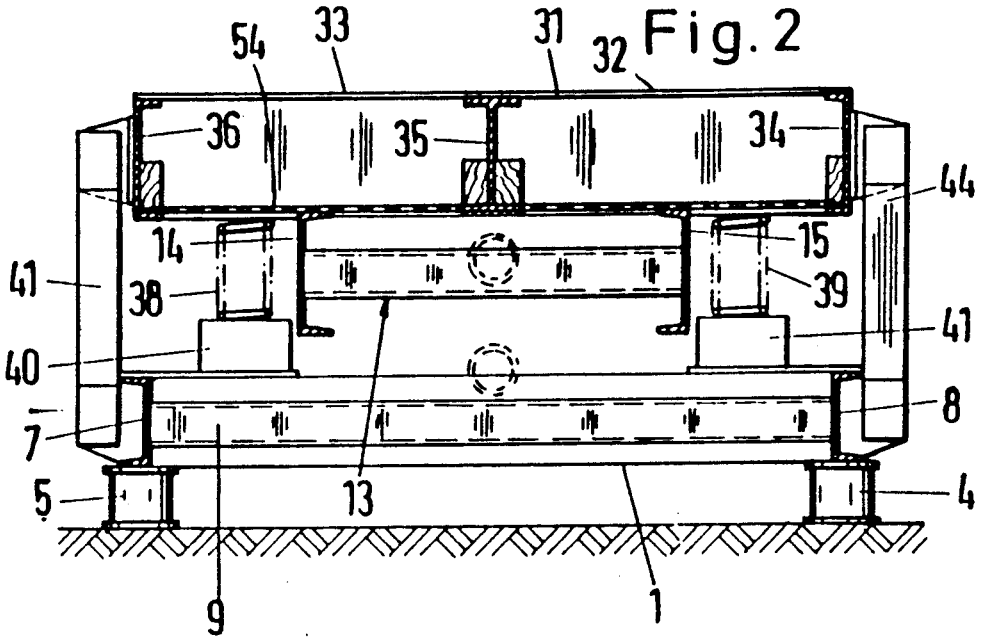
FIG. 2 is a view in a cross-section taken along line II—II in FIG. 1 through the screening machine.

A machine frame structure 1 is resiliently mounted on springs 2, 3, 4 and 5 on a foundation 6. The machine frame structure 1 comprises two side portions 7 and 8 which are connected together and held at a spacing by transverse bearers 9, 10, 11 and 12.

Provided on the machine frame structure 1 is a lower screening frame 13 which essentially comprises two side walls 14 and 15 which are connected together by way of an end wall 18 at their feed ends 16 and 17. Provided at the feed ends 16 and 17 of the side walls 14 and 15 are link springs 19 and 20 with which the lower screening frame 13 is resiliently mounted on the machine frame structure 1. At the discharge ends 21 and 22 of the lower screening frame 13, the latter is resiliently mounted on coil springs 23 and 24.

Secured to the discharge end of the lower screen frame 13 is an unbalanced drive 25 which causes the lower screening frame 13 to move in such a way that it performs circular movements in a vertical plane at its discharge end 21, 22.

Figures 3, 4, 5:
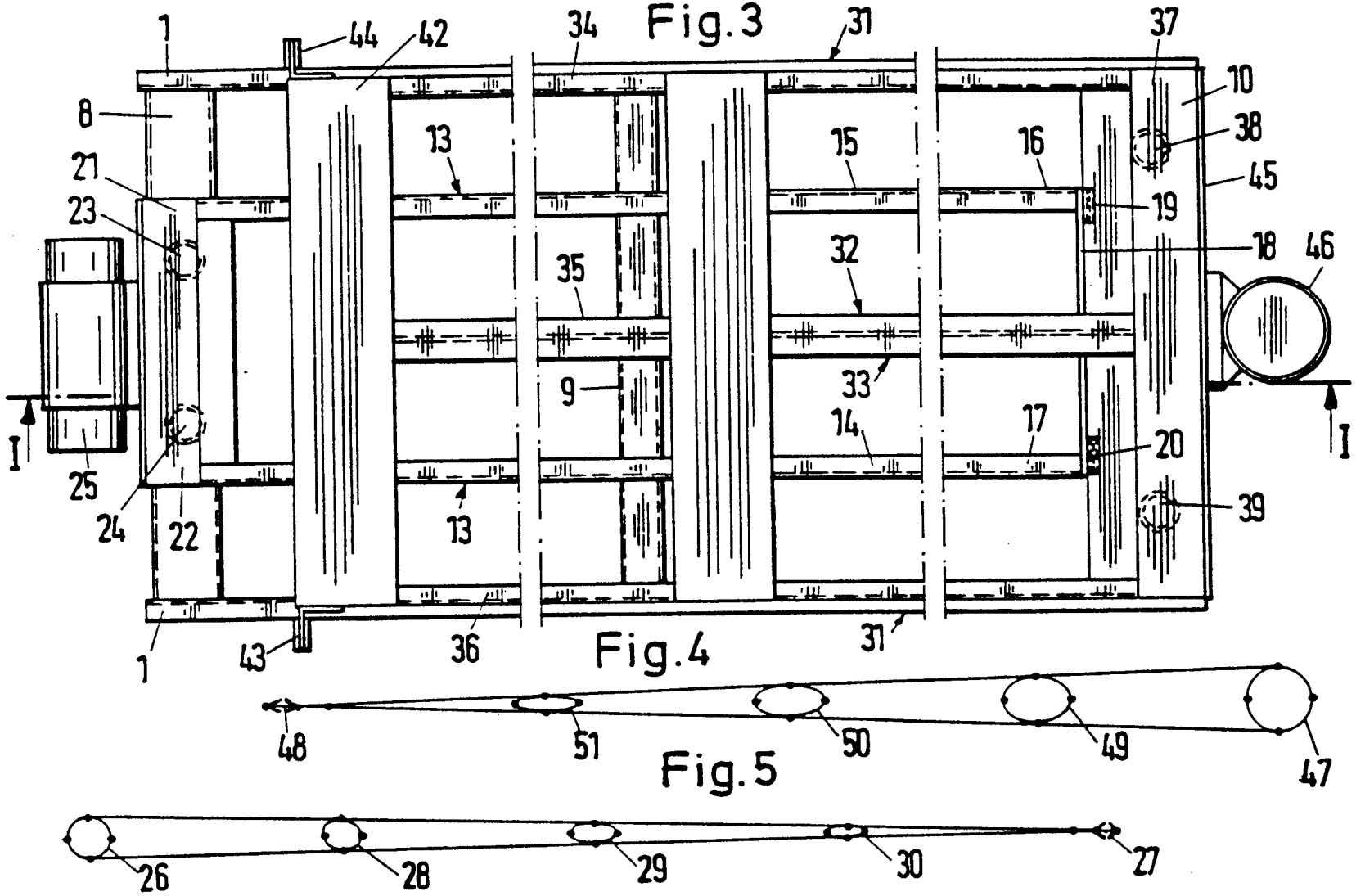
FIG. 3 is a plan view of the screening machine shown in FIG. 1.
FIG. 4 is a motion diagram for the upper screening frame of the screening machine.
FIG. 5 is a motion diagram of the lower screening frame of the screening machine.

The circular movements performed by the lower screening frame 13 are turned through 90° in FIG. 5 relative to the view shown in FIG. 3, that is to say they are illustrated in a horizontal plane. At the discharge ends 21 and 22 of the lower screening frame 13, the screening frame 13 performs a circular movement as indicated by the circle 26 while at the feed end it performs a translatory movement in the direction indicated by the double-headed arrow 27. In the regions between the feed end 16, 17 and the discharge end 21, 22 the lower screening frame 13 performs approximately elliptical movements as indicated by the ellipse-like curves 28, 29 and 30.

Provided on the machine frame structure 1 is an upper screening frame 31 which comprises two frames 32 and 33 which are arranged side-by-side.

The frame 32 is defined by the longitudinal bearers 34 and 35 and the frame 33 is defined by the longitudinal bearers 35, 36. At the feed end 37 of the upper screening frame 31 the latter is resiliently mounted on coil springs 38 and 39 on blocks 40 and 41. The blocks 40 and 41 are supported on the machine frame structure 1.

At the discharge end 42 of the upper screening frame 31 the latter is mounted on link springs 43 and 44 which are supported on the machine frame structure 1. Arranged at the end wall 45 at the feed end 37 of the upper screening frame 31 is an oscillating drive 46 which causes the upper screening frame 31 to be displaced with circular movements at the feed end 37.

These movements are shown in FIG. 4. At the feed end 37 the upper screening frame 31 performs the ciruclar movement 47 shown in FIG. 4, while the discharge end 42 of the upper screening frame 31 moves in one dimension in the direction indicated by the double-headed arrow 48. The movements of the upper screening frame 31 in the regions between the feed end 37 and the discharge end 42 correspond to the ellipse-like curves 49, 50 and 51 shown in FIG. 4.

The upper screening frame 31 and the lower screening frame 13 are arranged relative to each other in respect of height in such a way that the lower region 52 of the upper screening frame 31 and the upper region 53 of the lower screening frame 13 lie in a common plane. In that common plane, an elastic screening lining 54 is secured to the upper screening frame 31 and the lower screening frame 13. As a result, four screening web portions 55, 56, 57 and 58 are provided between the longitudinal walls 14 and 15 of the lower screening frame 13 and the longitudinal walls 34, 35 and 36 of the upper screening frame 31.

Figure 6:
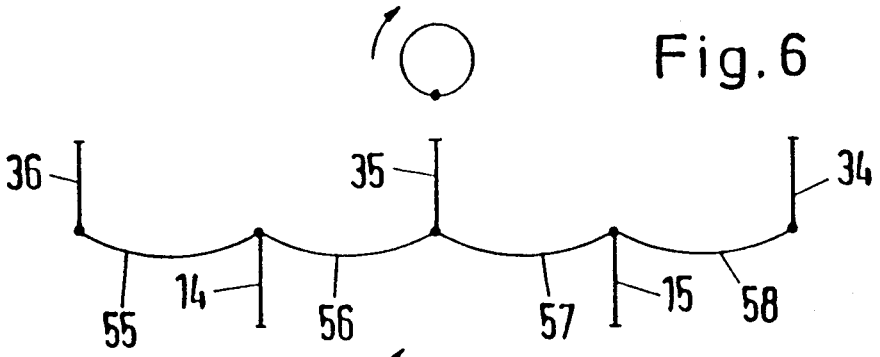
FIG. 6 is a diagrammatic view in cross-section through the screening machine in the central position of the screening frames.
Figure 7:
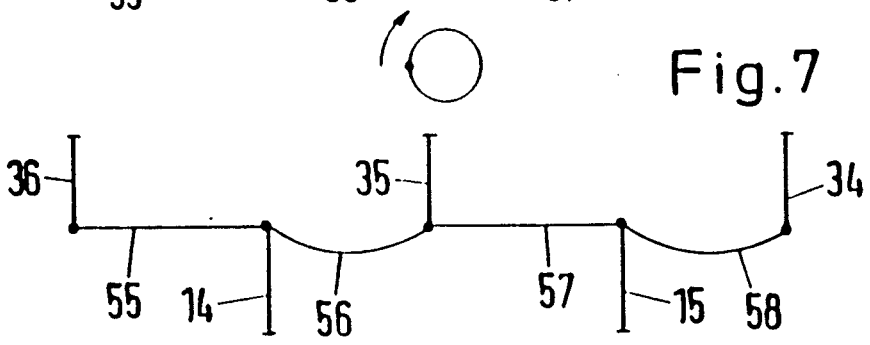
FIG. 7 is a view corresponding to that shown in FIG. 6 illustrating the screening frames in the one limit position.
Figure 8:
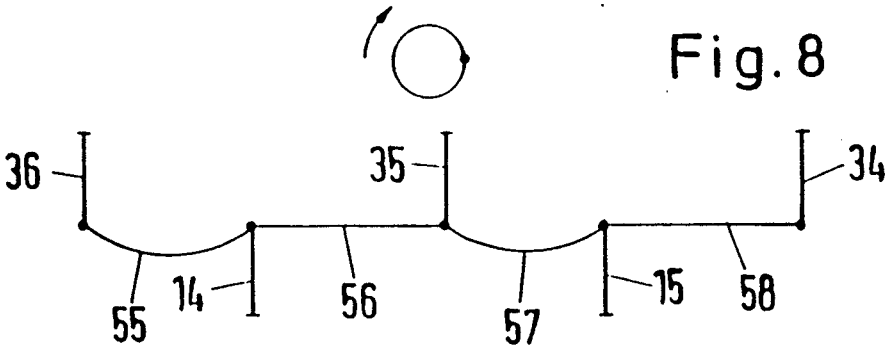
FIG. 8 is a view corresponding to that shown in FIG. 6 illustrating the screening frames in the other limit position.

In the rest condition of the two screening frames 13 and 31 and in the central position thereof the four screening web portions 55, 56, 57 and 58 sag or hang down loosely, as shown in FIG. 6. FIGS. 6, 7 and 8 show the condition of the four screening web portions 55, 56, 57 and 58 at the feed end 37 of the upper screening frame 31 and at the feed end 16 and 17 of the lower screening frame 13.

FIG. 7 shows the situation at the one point of reversal of movement of the screening frames 13, 31. In this situation the upper screening frame 31 is deflected towards the left relative to the lower screening frame 13 so that at that point of reversal of movement the screening web portions 55 and 57 are tensioned while the other screening web poirtions 56 and 58 sag down to a greater degree.

FIG. 8 shows the situation at the other point of reversal of movement of the screening frames 13 and 31, in which the upper screening frame 31 is deflected towards the right relative to the lower screening frame 13 so that at that point of reversal of movement the screening web portions 55 and 57 which previously had been tensioned sag while the previously sagging screening web portions 56 and 58 are now taut.

The condition of the screening web portions 55, 56, 57 and 58 changes from the condition shown in FIG. 7 to the condition shown in FIG. 8 and vice-versa, with the intermediate condition shown in FIG. 6 occurring between the two limit condition.

I claim:

1. A screening machine comprising two screening frames which are individually oscillated by an independent oscillating drive, the screening frames each having mutual oppositely located feed and discharge ends, and on which there is arranged an elastic screening lining characterized in that the two screening frames are associated with each other at different heights at a respective upper and lower position in such a way that a lower region of the upper screening frame and an upper region of the lower screening frame lie in a common plane, that the elastic screen lining is secured to the two screening frames in the common plane thereof and the upper screening frame is driven by its associated oscillating drive in a circular configuration in a horizontal plane at the feed end and the lower screening frame is driven by its associated oscillating drive in a circular configuration in a vertical plane at the discharge end.

2. A screening machine according to claim 1, characterized in that each oscillating drive is an unbalanced drive.

3. A screening machine according to claim 1, characterized in that each oscillating drive is an eccentric drive.

4. A screening machine according to claim 1, characterized in that both screening frames oscillate at different oscillation rates such that no beat phenomena occur.

5. A screening machine according to claim 1, characterized in that the upper screening frame is driven at an oscillation rate of approximately 500, 750, 1000 or 1500 oscillations per minute and the lower screening frame is correspondingly driven at an oscillation rate of approximately 750, 1000, 1500 or 3000 oscillations per minute respectively, or in correspondingly reversed relationship.

6. A screening machine to claim 1, characterized in that each screening frame is mounted at the respective driven end upon a spring means and at the oppositely located end upon a link means spring.

7. A screening machine comprising two screening frames which are individually oscillated by an independent oscillating drive, the screening frames each having mutual oppositely located feed and discharge ends, and on which there is arranged an elastic screening lining, characterized in that the two screening frames are associated with each other at different heights at a respective upper and lower position in such a way that a lower region of the upper screening frame and an upper region of the lower screen frame lie in a common plane, that the elastic screening lining is secured to the two screening frames in the common plane thereof and that the upper screening frame is driven by its associated oscillating drive in a circular configuration in a vertical plane at the feed end and the lower screening frame is driven in by its associated oscillating drive in a circular configuration in a horizontal plane at the discharge end.

8. A screening machine according to claim 7, characterized in that each oscillating drive is an unbalanced drive.

9. A screening machine according to claim 7, characterized in that each oscillating drive is an eccentric drive.

10. A screening machine according to claim 7, characterized in that both screening frames oscillate at different oscillation rates such that no beat phenomena occur.

11. A screening machine according to claim 7, characterized in that the upper screening frame is driven at an oscillation rate of approximately 500, 750, 1000 or 1500 oscillations per minute and the lower screening frame is correspondingly driven at an oscillation rate of approximately 750, 1000, 1500 or 3000 oscillations per minute respectively, or in correspondingly reversed relationship.

12. A screening machine according to claim 7, characterized in that each screening frame is mounted at the respective driven end upon a spring means and at the oppositely located end upon a link means.

13. A screening machine comprising two screening frames which are individually oscillated by an independent oscillating drive, the screening frames each having mutual oppositely located feed and discharge ends, and on which there is arranged an elastic screening lining, characterized in that the two screening frames are associated with each other at different heights at a respective upper and lower position in such a way that a lower region of the upper screening frame and an upper region of the lower screening frame lie in a common plane, that the elastic screening lining is secured to the two screening frames in the common plane thereof, and that the upper screening frame at its feed end, and the lower screening frame at its discharge end, are each driven by its associated oscillating drive in a circular configuration in a shared horizontal plane.

14. A screening machine according to claim 13, characterized in that each oscillating drive is an unbalanced drive.

15. A screening machine according to claim 13, characterized in that each oscillating drive is an eccentric drive.

16. A screening machine according to claim 13, characterized in that both screening frames oscillate at different oscillation rates such that no beat phenomena occur.

17. A screening machine according to claim 13, characterized in that the upper screening frame is driven at an oscillation rate of approximately 500, 750, 1000 or 1500 oscillations per minute and the lower screening frame is correspondingly driven at an oscillation rate of approximately 750, 1000, 1500 or 3000 oscillations per minute respectively, or in correspondingly reversed relationship.

18. A screening machine according to claim 13, characterized in that each screening frame is mounted at the respective driven end upon a spring means and at the oppositely located end upon a link means.

* * * * *